US006859188B1

(12) United States Patent
Matthews et al.

(10) Patent No.: US 6,859,188 B1
(45) Date of Patent: Feb. 22, 2005

(54) ROTATIONALLY CONFIGURABLE OFFSET REFLECTOR ANTENNA

(75) Inventors: James W. Matthews, Jamison, PA (US); Edwin Thomas Park, Levittown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/402,085

(22) Filed: Mar. 27, 2003

(51) Int. Cl.[7] ..... H01Q 13/00
(52) U.S. Cl. ..... 343/781 P; 343/882
(58) Field of Search ..... 343/781 P, 781 CA, 343/878, 880, 882, 756, 912, DIG. 2

(56) References Cited

U.S. PATENT DOCUMENTS 5,402,137 A * 3/1995 Ramanujam et al. .... 343/781 P
5,673,056 A * 9/1997 Ramanujam et al. ..... 343/756
6,239,763 B1 * 5/2001 Cuchanski ..... 343/781 P

* cited by examiner

*Primary Examiner*—Hoang V. Nguyen
(74) *Attorney, Agent, or Firm*—McDermott Will & Emery LLP

(57) ABSTRACT

An antenna system particularly suitable for use with a satellite in a terrestrial communication system includes first and second signal reflectors which are selectively positionable with respect to an RF signal feed whereby first and second target areas can be serviced. A support structure is provided for the reflectors whereby the first and second reflectors are rotated into operating positions with respect the RF signal feed. The support structure further includes a hinge for supporting the first reflector whereby the reflector can be rotated between an operating position and a stow position. The support structure further includes a second gimbal which allows the second reflector to independently rotate to a flipped position and then pivot to the stow position adjacent to the first reflector with the concave surfaces of the two reflectors in a stacked position.

13 Claims, 4 Drawing Sheets

ROTATIONALLY CONFIGURABLE OFFSET REFLECTOR ANTENNA

BACKGROUND OF THE INVENTION

This invention relates generally to antennas for use in transmission of radio wave signals, and more particularly the invention relates to reflector antennas in which a reflector reflects signals from a feed to a selected target area.

In geosynchronous satellites, for example, a radio signal from a feed such as a conical or rectangular horn or dipole is directed to selected areas on earth by a suitable reflector positioned to receive and reflect the radio waves. The reflector surface is generally concave and is typically parabolic or deviated slightly from parabolic to provide required pattern illumination.

Coverage requirements can change for a satellite. Heretofore, this would require the provision of two separate antenna systems which can be selectively switched into operation as required. However, the provision of two antenna systems increases cost and weight. Moreover, the presence of two independent antenna systems creates problems of storage during satellite deployment.

BRIEF SUMMARY OF THE INVENTION

In accordance with the invention, an antenna system is provided with at least two reflectors which can be used with a single signal feed. The reflectors can have different reflecting surfaces whereby different target areas are addressed by the reflectors. A mechanism is provided for selectively moving one reflector into position for use with the signal feed while moving the other reflector into a non-operating position. In a preferred embodiment, the two reflectors are supported by the same structure which can be rotated for positioning a reflector in an operating position with respect to the signal feed.

In accordance with another aspect of the invention, the reflectors are rotated to a stow position during deployment. One reflector can be rotated directly to the stow position, while the other reflector is first flipped and then rotated to the stow position so that concave surfaces of the two reflectors have the same orientation for stacking.

The invention and objects and features thereof will be more readily apparent from the following detailed description and appended claims when taken with the drawing.

DETAILED DESCRIPTION OF THE INVENTION

Figure 1A:
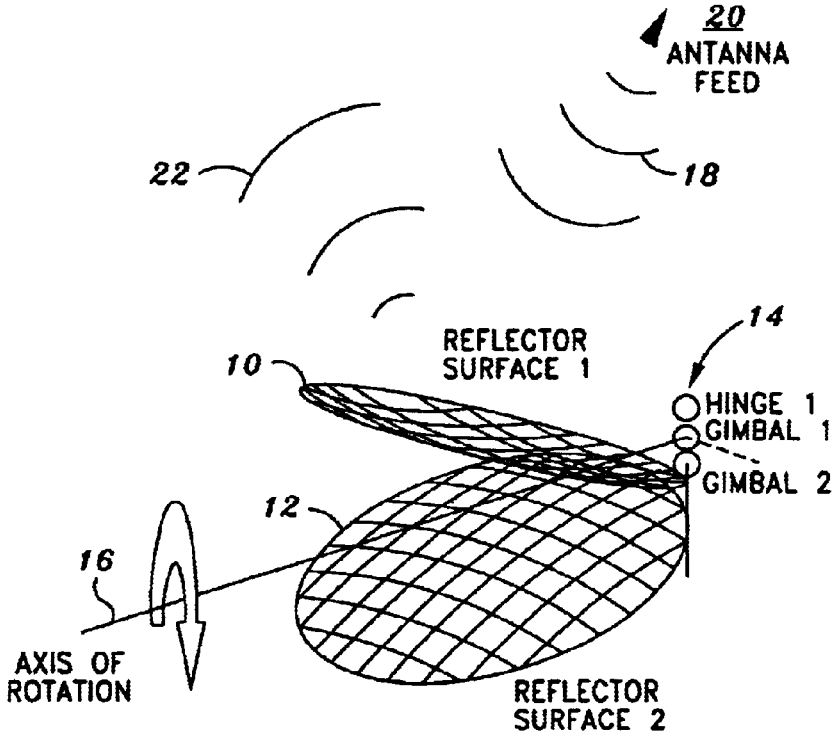
FIGS. 1A, 1B are perspective views of an antenna system having two reflectors in accordance with one embodiment of the invention.
Figure 1B:
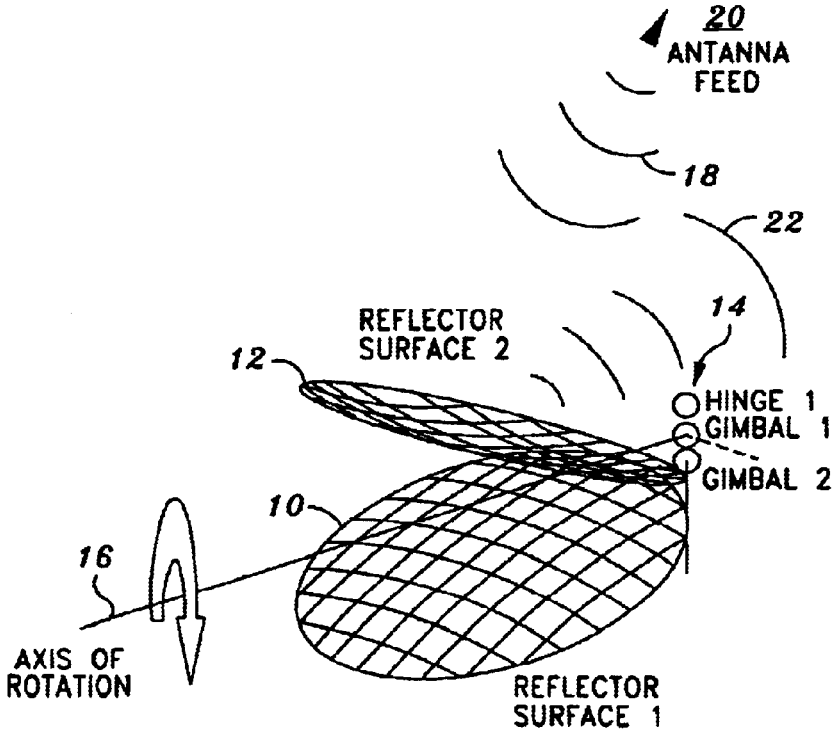

FIG. 1A is a perspective view illustrating a two-reflector antenna system in accordance with one embodiment of the invention. A first reflector 10 and a second reflector 12 are mounted on a support structure 14 including a hinge 1, a gimbal 1, and a gimbal 2. Gimbal 1 of the support structure is used to rotate reflector 10 and reflector 12 around an axis 16 so that reflector 10 is positioned to receive radio waves 18 from an antenna feed 20 and reflect the radio waves at 22 to a first target area. Alternatively, as shown in FIG. 1B, reflector 12 can be rotated about axis 16 to reflect waves 18 and direct the waves at 22 to a second target area.

Figure 1C:
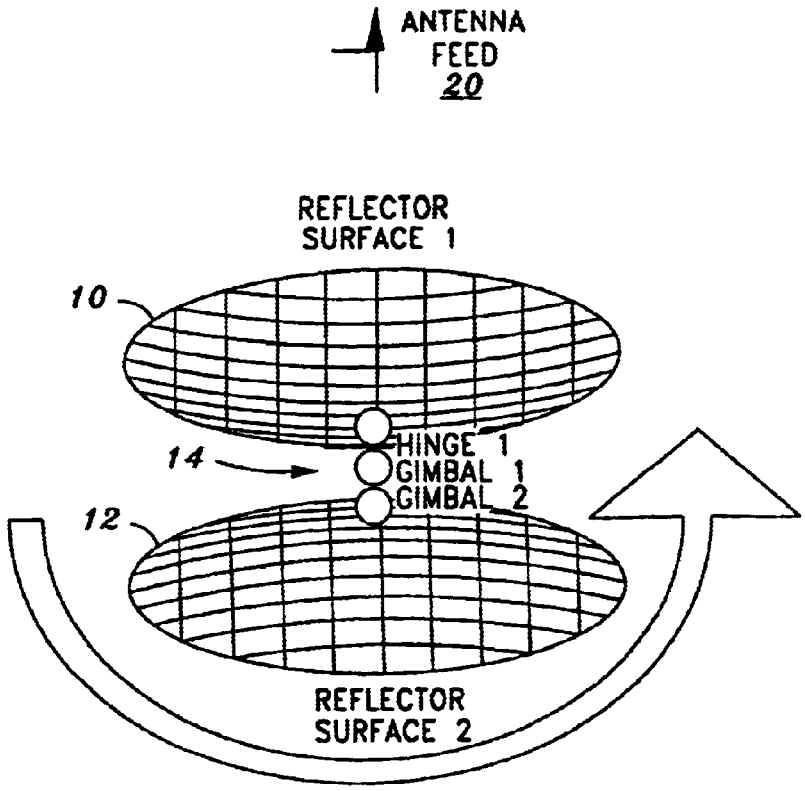
FIGS. 1C, 1D are a side view and front view, respectively, of the antenna system of FIGS. 1A, 1B.
Figure 1D:
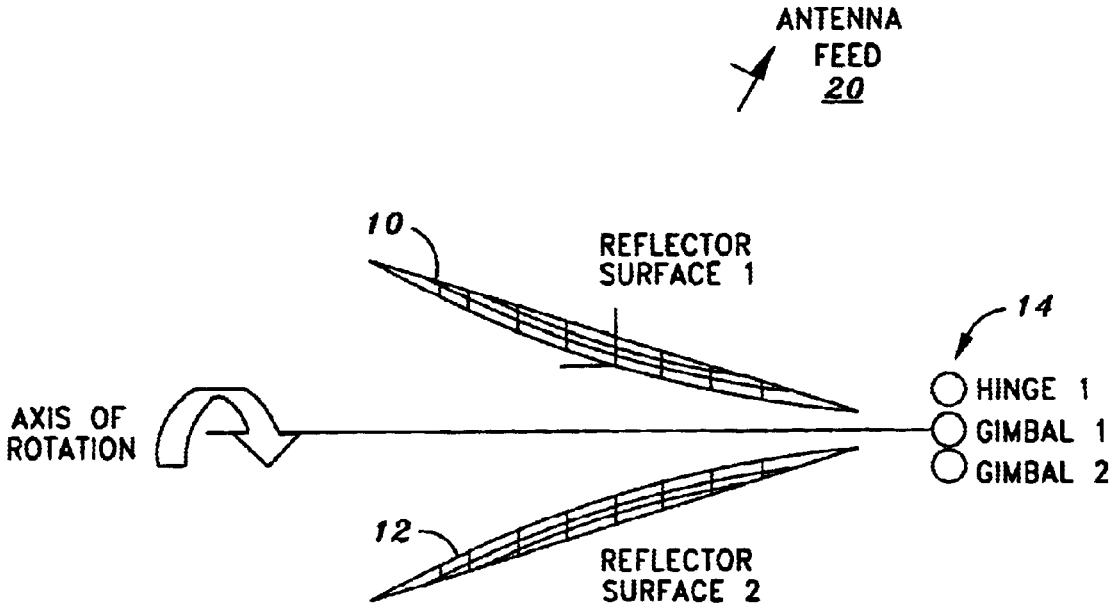

FIG. 1C is a front view of the antenna system looking down axis 16, and FIG. 1D is a side view of the antenna system. Each of the reflectors 10, 12 has a concave surface which receives the RF waves from antenna feed 20, the concave surface typically being parabolic or a slight variation from parabolic to provide a required pattern illumination. The concave surface of reflector 2 differs from the concave surface of reflector 10 whereby the direction of reflected waves differs between the two reflectors.

Thus, it is seen that in accordance with the invention at least two reflectors can be used with the same antenna feed in order to selectively direct radio waves to a plurality of target areas. This obviates the need for separate antenna systems and consequently reduces the cost and weight of the antenna system.

In accordance with another aspect of the invention, the two reflectors can be moved to a stow position by support structure 14. This is illustrated in FIGS. 2A–2F which are side views of the antenna system showing movement of the reflectors from an operating position to a stow position.

Figure 2A:
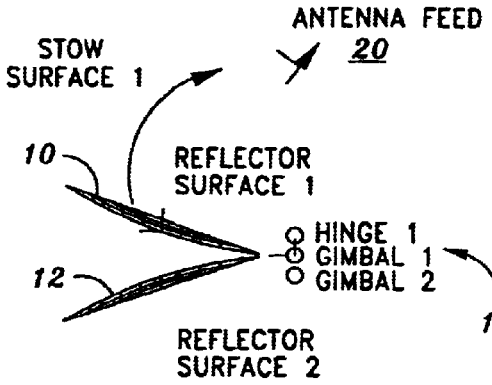
FIGS. 2A–2F are side views of the antenna system of FIG. 1 illustrating steps in stowing the reflectors.
Figure 2B:
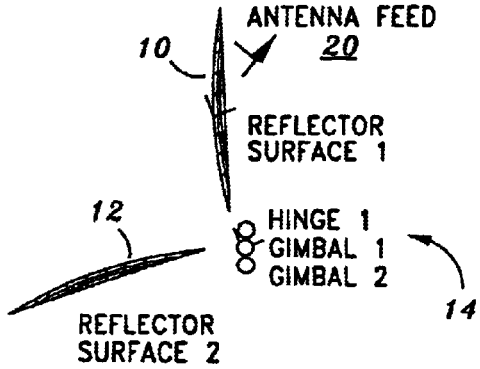
Figure 2C:
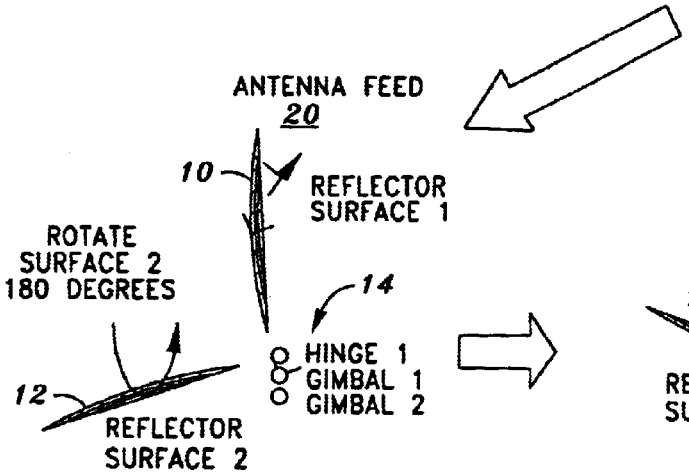
Figure 2D:
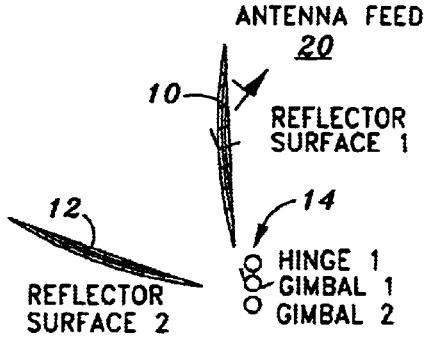
Figure 2E:
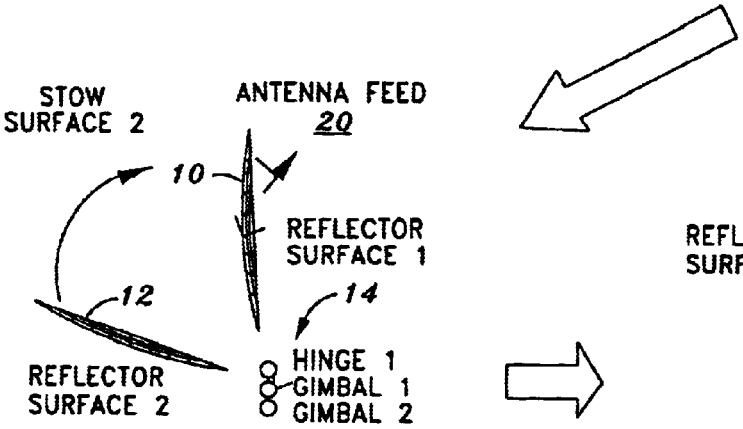
Figure 2F:
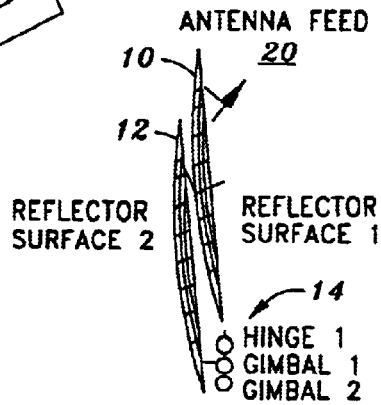
Figure 3:
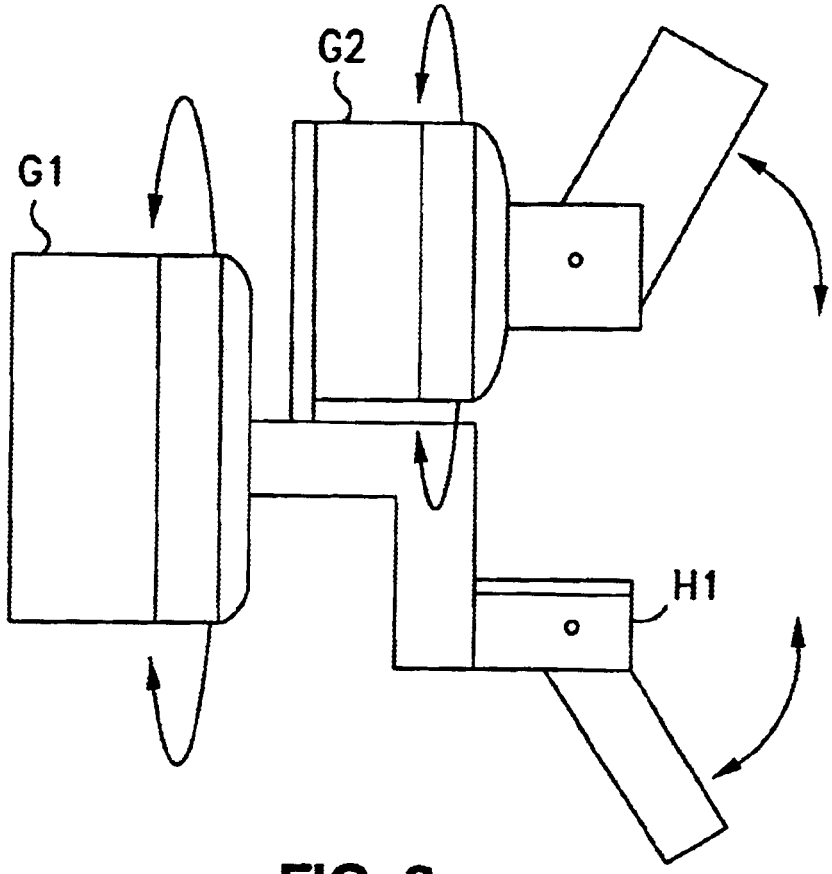
FIG. 3 is a schematic representation of the hinge and gimbels of the antenna system.

In FIG. 2A, hinge 1 of the support structure allows reflector 10 to rotate from an operating position to a generally vertical position adjacent to antenna feed 20 as shown in FIG. 2B. Gimbal 2 of support structure 14 is coupled to reflector 12 and permits the reflector to be rotated as shown in FIG. 2C to assume a flipped position as shown in FIG. 2D. By flipping reflector 12, the concave surfaces of reflectors 10, 12 are oriented for stacking. In FIG. 2E gimbal 2 now rotates reflector 12 vertically until it assumes a stow position immediately adjacent to reflector 10 as shown in FIG. 2F. The stowage mechanism is particularly advantageous in a geosynchronous satellite application where the antennas can be stowed during satellite positioning. In this embodiment, hinge 1 and gimbel 2 are carried by gimbel 1. Gimbel 1 rotates reflectors 10 and 12 to operating positions, as shown in FIGS. 1A and 1B. When reflector 10 is in an operating position (FIG. 2A) the reflector can be rotated to the stow position (FIG. 2B) by hinge 1. Thereupon, reflector 12 can be flipped by gimbel 2 (FIG. 2C) and then rotated to the stow position (FIG. 2F). FIG. 3 is a schematic representation of gimbel 1 (G1) driving hinge 1 (H1) and gimbel 2 (G2).

An antenna system in accordance with the present invention in which a plurality of reflectors can be selectively used with a single antenna feed for coverage of different target areas provides flexibility in use while reducing the cost and weight of the antenna system. The antennas are readily moved from an operating position to a stowed position through use of the support mechanism employing hinges and gimbals for selectively rotating the reflectors.

While the invention has been described with reference to a specific embodiment, the description is illustrative of the invention and is not to be construed as limiting the invention. For example, while the antenna system has particular applicability in a satellite communication system, the antenna system can readily be employed in a ground-based system. Thus, various modifications and applications may occur to those skilled in the art without departing from the true spirit and scope of the invention as defined by the appended claims.

What is claimed is:

1. An antenna system comprising:

a) an RF signal feed, b) a first signal reflector positionable with respect to the signal feed for directing RF signals to a first target area;

c) a second signal reflector positionable with respect to the signal feed for directing RF signals to a second target area, and d) a support structure for the first and second signal reflectors for selectively positioning the reflectors with respect to the RF signal feed, the support structure further including a hinge for supporting the first signal reflector whereby the first signal reflector can be rotated to a stow position.

2. The antenna system as defined by claim 1 wherein the support structure rotatably supports the first and second reflectors for rotating the reflectors into position with respect to the RF signal feed.

3. The antenna system as defined in claim 2 wherein the reflecting surfaces of the two reflectors are concave.

4. The antenna system as defined by claim 3 wherein the concave surfaces are at least approximately parabolic in shape.

5. The antenna system as defined by claim 4 wherein the reflecting surfaces are different so that different target areas are addressed by the two reflecting surfaces.

6. The antenna system as defined by claim 5 wherein the support structure includes a first gimbal for rotating the reflectors into position with respect to the signal feed.

7. The antenna system as defined by claim 6 wherein the support structure includes a second gimbal for supporting the second signal reflector whereby the second signal reflector can be flipped and then rotated into the stow position with the first reflector and whereby the concave surfaces of the first and second reflectors are oriented for stacking.

8. An antenna system comprising:

a) an RF signal feed;

b) a first signal reflector having a concave reflecting surface positionable with respect to the signal feed for directing RF signals to a first target area;

c) a second signal reflector having a concave reflector surface for directing RF signals to a second target area, and d) a support structure for the first and second signal reflectors for selectively positioning the reflectors with respect to the RF signal feed, the support structure further including a hinge for supporting the first signal reflector whereby the first signal reflector can be rotated to a stow position.

9. The antenna system as defined in claim 8 wherein the reflecting surfaces are different so that different target areas are addressed to the two reflector surfaces.

10. The antenna system as defined by claim 9 wherein the support structure includes a first gimbal for rotating the reflectors into position with respect to the signal feed.

11. The antenna system as defined by claim 10 wherein the support structure includes a second gimbal for supporting the second signal reflector whereby the second signal reflector can be flipped and then rotated into the stow position with the first reflector, and whereby the concave surfaces of the first and second reflectors are oriented for stacking.

12. The antenna system as defined by claim 8 wherein the antenna feed comprises a horn.

13. The antenna system as defined by claim 8 wherein the signal feed comprises a dipole.

* * * * *